United States Patent [19]

Elrick et al.

[11] 4,029,529

[45] June 14, 1977

[54] CROSSLINKED CARBOXYL CONTAINING POLYMER AND NITROCELLULOSE AS SOLID PROPELLANT BINDER

[75] Inventors: Donald E. Elrick, Rawlings; Harry Gilbert, Cumberland, both of Md.

[73] Assignee: The United States of America as represented by the Secretary of the Navy, Washington, D.C.

[22] Filed: July 12, 1967

[21] Appl. No.: 653,301

[52] U.S. Cl. ..... 149/19.6; 149/19.8; 149/19.9; 149/19.91; 149/19.92; 149/96

[51] Int. Cl.[2] ..... C06B 45/10

[58] Field of Search ..... 149/94, 95, 18, 19, 149/96, 97, 19.6, 19.8, 19.9, 19.91, 19.92

[56] References Cited

UNITED STATES PATENTS

| | | | |
|---|---|---|---|
| 3,036,939 | 5/1962 | Camp | 149/19 |
| 3,260,203 | 7/1966 | Godfrey et al. | 149/19 X |
| 3,280,746 | 10/1966 | Brown et al. | 149/19 X |
| 3,726,729 | 4/1973 | Pierce | 149/96 X |
| 3,878,003 | 4/1975 | Le Presti et al. | 149/19.8 |

*Primary Examiner*—Edward A. Miller
*Attorney, Agent, or Firm*—R. S. Sciascia; A. L. Branning

[57] ABSTRACT

An energetic binder composition of a carboxy polymer, such as an acrylic polymer, mixed with nitrocellulose and cross-linked with a multifunctional curing agent. A composite type propellant in which the energetic binder is combined with an oxidizer and process for preparation thereof.

16 Claims, No Drawings

CROSSLINKED CARBOXYL CONTAINING POLYMER AND NITROCELLULOSE AS SOLID PROPELLANT BINDER

The invention described herein may be manufactured and used by or for the Government of the United States of America for governmental purposes without the payment of any royalties thereon or therefor.

BACKGROUND OF THE INVENTION

This invention relates to propellant binders and more specifically to an energetic binder composition useful in solid, composite-modified single and double base propellants, and a process for the preparation of such propellants.

Present day composite type propellants ordinarily consist of one or more solid inorganic or organic oxidizers uniformally distributed in particulate form throughout a matrix of an energetic plastic, resinous or elastomeric binder material, such as nitrocellulose, which serves as the fuel component for the combustion reaction. Depending upon whether the propellant contains a single combustible material, such as nitrocellulose, or a mixture of more than one combustible material, such as nitrocellulose admixed with nitroglycerin, the propellant is classified as either single or double base.

Solid composite propellants are generally prepared by mixing the solid particulate oxidizer with a resinous or elastomeric liquid matrix, and solidfying the composition after a uniform dispersion of the solid is obtained. According to previous studies, improved mechanical properties such as superior creep life, tensile strength and elongation, are obtained by chemically cross-linking the matrix either prior to or subsequent to solidification. Such improved mechanical properties are highly desirable in preventing alteration of burning characteristics due to internal cracking of the propellant grain either during processing or as a result of the high localized stresses generated during rocket flight.

Prior attempts to cross-link nitrocellulose-containing propellants, however, have been largely unsuccessful due mainly to the absence of a suitable cross-linking agent. Common cross-linking agents, such as the isocyanates, are generally unsatisfactory due to their tendency to react with residual moisture which generates carbon dioxide and creates internal voids within the propellant grain. Unless the matrix material is rigorously dried prior to cross-linking, formation of voids may result in serious weakening of mechanical and ballistic properties. Relatively large voids, in fact, tend to result in severe malfunctioning of the motor.

SUMMARY OF THE INVENTION

It is therefore an object of this invention to provide a novel nitrocellulose energetic-binder composition with superior mechanical and ballistic properties.

It is a further object of this invention to provide a highly cross-linked energetic binder which is resistant to reaction with residual moisture and is capable of being processed without resorting to a rigorous drying of the casting powder, an operation which is costly and hazardous.

It is also an object of this invention to provide a process for preparing the aforementioned novel energetic binder compositions which avoids the formation of voids in the product propellant.

It is further an object of this invention to provide a novel composite type single or double base solid cast propellant composition using the aforementioned cross-linked energetic binders.

In accordance with this invention these and other objects are accomplished by providing an energetic binder composed of an admixture of nitrocellulose with a carboxy polymer and cross-linking the admixture with a multifunctional curing agent. The term "polymer" is used herein to include homopolymers, copolymers, terpolymers, etc. Further, this invention relates to a novel solid composite rocket propellant composition wherein a particulate oxidizer is uniformally distributed through a matrix of a cross-linked resin mixture of nitrocellulose and a carboxy polymer. Nitrocellulose is blended with the carboxy polymer in a suitable casting solvent and cured with a cross-linking agent for up to 14 days at 45°–60° C. Subsequent to curing, the admixture is treated at 0°–30° C for 3 to 14 days, which treatment swells and coalesces the casting powder and enables superior cross-linking.

DESCRIPTION OF THE PREFERRED EMBODIMENTS

Among preferred embodiments of this invention is the admixture of from about 1-98.5 wt. % nitrocellulose with from about 1-33 wt. % acrylic polymer having a carboxyl equivalent of from about 0.03 to 0.06 equivalents per hundred grams, which blend is cross-linked with at least 0.5% of an amino epoxy novalac in an amount sufficient to improve the mechanical properties of the binder relative to the non-crosslinked binder.

The multifunctional cross-linking agent of this invention serves to link the nitrocellulose with the carboxy polymer forming a three dimensional gel network. Infrared spectroscopy has shown that the hydroxyl group of the nitrocellulose reacts with one of the functional groups of the cross-linking agent and the carboxy group reacts with a second functional grouping on the same molecule.

Any multifunctional cross-linking agent capable of reacting with both a hydroxyl and a carboxyl group is generally contemplated within the scope of this invention. Of those particularly preferred, however, are the mutlifunctional epoxides and the aziridinyl cross-linking agents. Among those epoxides generally applicable are the amino epoxy novalacs, the condensation products of bisphenol A and epichlorohydrin represented by the formula:

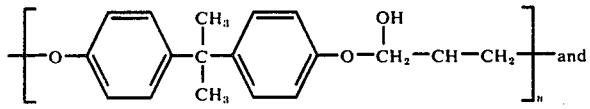

and cycloaliphatic epoxides.

The epoxide whose reactivity makes it especially useful in this invention is N,N,O-tris(epoxypropyl). p-aminophenol,

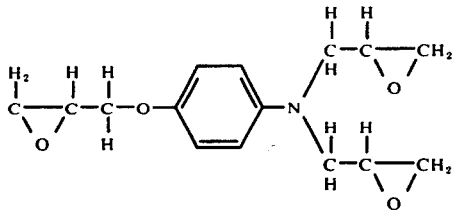

which is available from Union Carbide Corporation under the trade name "ERLA-0510." Other epoxides which can be used either alone or with the above includes DER-332 from Dow Chemical Company (the condensation product of Bis-phenol A and epichlorohydrin), Epon 812 from Shell Chemical Company (the condensation product of glycerine and epichlorohydrin) and Union Carbide Corporation's UNOX-221 (3,4-epoxycyclohexyl methylcarboxyl-3,4-epoxycyclohexane).

Among the aziridinyl curing agents applicable are tris(2-methyl aziridinyl) phosphine oxide, the butyleneimine adduct of trimesic acid, and 1,10-di-(1-aziridinyl) 1,10-dioxadecane. Good results are obtainable generally with the bis(2-methyl-aziridinylethyl) sulfone.

The amount of curing agent reacted is naturally dependent on the specific composition. Generally however, less than 0.5 wieght % will not result in sufficient cross-linking to obtain the significant improvements in mechanical properties contemplated by this invention. The upper limit of curing agent is not critical and is dependent only upon the equivalent weights of the acrylic polymer, nitrocellulose and particular curing agent. Considering the usual equivalent weights of the preferred acrylic polymer and preferred nitrocellulose, maximum curing agent which normally will react is about 5%. Greater amounts, however, may be used without adverse affects.

Any carboxy type polymer is herein applicable but it is preferred that the polymer have a carboxy equivalent of from about 0.03 to about 0.06 equivalents/hundred gms. to provide sufficient sites for cross-linking. Among those carboxy polymers specifically contemplated are the acrylic polymers, wherein at least one monomer is the acid or lower alkyl ester of acrylic acid, methacrylic acid, sorbic acid, beta-acryloxy propionic acid, ethacrylic acid, 2-ethyl-3-propylacrylic acid, vinylacrylic acid, cinnamic acid, maleic acid and combinations thereof such as acrylic acid with ethyl acrylate. Also applicable are copolymers of a carboxy monomer with a non-carboxy monomer such as methyl acrylate, methyl methacrylate, ethyl methacrylate, styrene, acrylonitrile, methacrylonitrile, vinylidene chloride, butadiene, isoprene, 2,3-dimethyl-butadiene, chloroprene and combinations thereof. The copolymer of ethyl acrylate and acrylic acid is particularly preferred, however, because of its miscibility with nitrocellulose and its relatively low glass-transition temperature.

While the type of nitrocellulose is not critical, preferred is military grade nitrocellulose (12.6% N and 10-18 second viscosity). Nitrocelluloses of higher nitrogen content or higher hydroxyl content are also applicable for special purpose binders.

Depending on the curing agent, the cross-linking reaction may require a catalyst or a combination of catalysts. Some diepoxides, for example DER-332, require a catalyst such as a chromium salt. Depending on the cross-linking agent, other catalysts which might be used are: the quaternary ammonium salts such as benzylcetyldimethyl ammonium chloride, the tertiary amines and others.

In general, any solvent or plasticizer for nitrocellulose can be used as a solvent for the mixed resin propellant system of this invention. Some of the more preferred solvents include nitroglycerin, 1,2,4-butanetrinitrate, metriol trinitrate, pentaerythritol trinitrate, diglycol dinitrate, the nitro compound bis-dinitropropyl acetal, glycerol triacetate (triacetin), dibutyl adipate, dimethyl phthalate, dihexyl phthalate, diethylene glycol, diglycol monoethyl ether, Santicizer 8 (o - and p - toluene ethyl sulphonamides), isophorone (3,5,5-trimethyl-cyclohexane-2-one-1) and butylene dicyanoacetate, as well as mixtures of the above.

In general, the method of preparing a composite propellant according to this invention includes blending up to 98.5%, based on the weight of the binder, of nitrocellulose with at least 1%, based on the weight of the binder, of a carboxy polymer having a carboxyl equivalent of from about 0.03 to 0.06 equivalents per hundred grams, with a multifunctional curing agent in a suitable casting solvent and curing the admixture for up to 14 days at 45°–60° C. The admixture is pretreated with the casting solvent at 0°–40° C for 2-14 days prior to the curing so as to swell and coalesce the powder.

The maximum amount of carboxy polymer substitutable for the nitrocellulose is not critical although cross-linking the carboxy polymer alone does not provide a matrix of adequate strength. Preferably, except for special purpose compositions, more than 33% carboxy polymer is not desired since it tends to decrease tensile strength and modulus. The minimum quantity of nitrocellulose is also not critical, however, normally a minimum of at least 10% is' desirable.

One of the advantages of the binder system of this invention is its ability to bind proportionately large quantities of solid oxidizers, often as high as 85%, of the total propellant composition. Consequently, propellants with higher specific impulse are possible using this invention.

The insoluble oxidizers can be any suitable, active oxidizing agent which yields oxygen readily for combustion and which does not react with the carboxy or hydroxy groups. Suitable oxidizers include the inorganic oxidizing salts such as the perchlorates of ammonium, sodium, potassium, and lithium, the nitrates, and organic compositions such as hydrazine nitroformate, nitroquanidine, pentaerythritol tetranitrate, mannitol hexanitrate, cyclotrimethylene trinitramine, trinitrotoluene, hexanitrodiphenylamine, and cyclotetramethylene tetranitroamine and mixtures thereof.

Finely divided solid fuels such as aluminum, magnesium, zirconium, boron, beryllium, titanium, silicon and hydrides such as aluminum, beryllium and lithium aluminum hydride can be introduced into the propellant compositions as an additional fuel component. The metals and metal hydrides possess the advantage of increasing density and/or improving specific impulse because of their high heats of combustion.

Other additives which may also be optionally included are, for example, burning rate catalysts, such as ammonium dichromate, copper chromate and ferric ferrocyanide, coolants for reducing the temperatures of the generated gases, such as oxamide, monobasic ammonium phosphate, barbituric acid and ammonium oxalate. Stabilizers for the nitrocellulose such as 2-nitrodiphenylamine, ethyl Centralite and resorcinol are also desirable especially when a nitrate or perchlorate compound is used as the oxidant.

The present invention can better be understood by reference to the following examples which are presented for purposes of illustration only and should not be regarded as limiting in any manner. In the examples the parts and percentages are by weight unless otherwise indicated.

EXAMPLE I

One sample of casting powder was prepared using the following steps: Dry fibrous nitrocellulose (12.6% N) (114 g), 205.8 g. of 25 $\mu$ (average particle size) cyclotetramethylene tetranitramine (HMX), which had been allowed to stand with 200 g of acetone, and 6 g of polyethyl acrylate-acrylic acid (with 0.047 ephr. of carboxyl) were mixed for 20 minutes with the acetone at 20°–30° C in a one-quart fixed volume, sigma blade Day Mixer. Microatomized (10 $\mu$ average particle size) ammonium perchlorate (60 g) and 11.2 g of resorcinol (a 10% excess to compensate for that which evaporates during processing) were added with 20 g of acetone and mixed for ten minutes. Alcoa 123 aluminum (150 g) and 0.18 g of benzyl cetyl dimethyl ammonium chloride were added with 60 g acetone and mixed for 20 minutes. 2-Nitrodiphenylamine (6 g) and 59.4 g of nitroglycerin (a 10% excess to compensate for that which evaporates during processing) were added and mixed for two hours. Temperature was gradually increased to about 50° C by introducing hot water through the mixer jacket during the final hour of mixing to obtain a dough that had a satisfactory consistency for pressing.

The casting powder dough was pressed through a 51 mil circular die at a presure of 200 psi and rate of 2.3 in/sec to form a continuous strand using a preheated (110° F) Hanna 2-¾ inch vertical press whose bowl had been wetted with acetone. The long strand of acetone-wet casting powder was cut into 63 mil (average) lengths using a McKeiman-Terry small arms cutting machine. The resulting right cylinders of casting powder were dried for three days at 20°–30° C and four days at 60° C to obtain casting powder with average diameter and length of 63 mil and an absolute density of 1.83 g/ml. Casting powder was coated with 0.05% of graphite by combining the powder with the desired amount of graphite and tumbling the materials for three hours in an open barrel containing baffle plates.

The interior of a curing container consisting of a 6-¾ inches length, 2-⅛ inches diameter (O.D.) cylinder of 1/8 inch cellulose acetate (CA) was coated with an epoxide-amine solution. The solution was cured at 25° C for one day and 50°–60° C for one day. The container was equipped with a CA bottom plate, 0.39 inch diameter, 2 inches length CA tubing in the bottom plate, No. 13 hard rubber stopper and ¾ inch diameter, 2 inches length HiFax tubing in the stopper. A piece of cotton was placed over the bottom outlet to prevent clogging of the outlet by casting powder granules. A 2-¾ inches diameter, 8 gage steel wire screen was placed on top of the casting powder. The screen was held in place by a CA ring which was cemented to the CA beaker using acetone as a solvent. Prior to cementing it was necessary to scrape away the cured epoxide-amine mixtures from the area that the CA ring would contact.

To 454 g of casting powder in the CA curing container was added via bottom casting about 250 g of a casting solvent containing 87.9% nitroglycerin, 9.0% glycerol triacetate, 1.1% ERLA-0510, 1% resorcinol and 1% 2-nitrodiphenylamine. The casting was allowed to cure for three days at 25° C and a total of 14 days at 49° C. Excess casting solvent was poured from the top of the casting and the resulting casting was found by weight differences to contain 69.9% casting powder and 30.1% casting solvent. The casting was sawed into 0.25 inch thick slices and short JANAF type 2 dumbbells were die-cut from the slices. Dumbbells which were tested at 77° F at a 0.74 in/in/min strain rate gave a 590 psi modulus, 240 psi tensile strength and 60% elongation. A dumbbell did not break in 312 hours at 25° C when a 50 psi stress was applied (strain was 30%). The average life of flammability cubes (the time required for ½ × ½ = 1 inch blocks to burn) at 80° C was 16 days.

EXAMPLE II

An alternate method of preparing casting powder would be that normally used in production. 12.6% N fibrous nitrocellulose (102 g) which as wet with 58 g of 95% ethanol was mixed in the Day mixer for ten minutes. 2-Nitrodiphenylamine (6 g) and 52.8 g of nitroglycerin (10% excess) were added and mixed for 20 minutes. HMX (211.8 g) which has been allowed to stand for four hours with 200 g of a 60% acetone-40% ethanol solution was added with the solution and mixed for 20 minutes. Microatomized ammonium perchlorate (54 g), 18 g of poly(ethyl acrylate-acrylic acid) (0.047 ephr.) and 11.2 g (10% excess) of resorcinol were added and mixed for ten minutes. Alcoa 123 aluminum (150 g) was added and mixed for a total of two hours. During the final 90 minutes of mixing, the mixer was heated in order to obtain dough with the proper consistency for pressing. The dough was transferred to Hanna press and pressed through a 51 mil diameter die at a pressure of 600 psi and rate of 18.9 in/sec to obtain a continuous strand. The acetone-alcohol wet casting powder strand was cut into 63 mil lengths using a McKeinam-Terry cutting machine. The solvent-wet powder was dried three days at 20°–30° C and four days at 60° C and was coated with 0.05% graphite to obtain a casting powder with dimensions of 63 mil average length and 63 mil diameter and absolute density of 1.89 g/ml.

Casting powder and a casting solvent containing 88.7% nitroglycerin, 9% glycerol triacetate, 1.3% ERLA-0510, 1.3% resorcinol and 2% 2-nitrodiphenylamine were combined using a bottom casting technique to obtain, after a three-day cure at 20°–25° C and 14-day cure at 140° C and cleaning, a cast propellant with a 71.7 to 28.3 powder to solvent ratio. The casting was machined to prepare JANAF dumbbells which gave a 640 psi modulus, 276 psi tensile strength and 46% elongation at a strain rate of 0.74 in/in/min at 77° F. A dumbbell did not break in 191 hours at 25° C when a 50 psi stress was applied (strain was 34%). Propellant density was 1.783 g/ml.

EXAMPLE III

A casting powder which was prepared using techniques described in example I and which contained 18% of 12.6% N nitrocellulose, 2% of poly(ethyl acrylate-acrylic acid), 10% of 10 $\mu$ ammonium perchlorate, 35.3% of 25 $\mu$ HMX, 25% of Alcoa 123 aluminum, 8% nitroglycerin, 1% of 2-nitrodiphenylamine and 1.7% resorcinol was combined with a casting solvent containiner 87.8% nitroglycerin, 9% triacetin, 1.2% ERLA-0510, 1% resorcinol and 1% 2-nitrodiphenylamine to obtain after cure a cast propellant which had a 71.4 powder to 28.6 solvent ratio and which has the following mechanical properties at a 0.74 in/in/min rate at 77° F: 660 psi modulus, 250 psi tensile strength and 52% elongation. A dumbbell did not break in 312 hours at 25° C when a 50 psi stress was applied (strain was 30%). The average life of flammability cubes was 17 days at 80° C.

EXAMPLE IV

A casting powder which was prepared using techniques described in example I and which contained 15% 1f 12.6% N nitrocellulose, 5% of poly(ethyl acrylate-acrylic acid, 10% of 10 $\mu$ ammonium perchlorate, 35.3% of 25 $\mu$ HMX, 25% of Alcoa 123 aluminum, 7% of nitroglycerin, 1% of 2-nitrodiphenylamine and 1.7% resorcinol was combined with a casting solvent containing 88.5% nitroglycerin, 9% triacetin, 1% 2-nitrodiphenylamine and 1.5% ERLA-0510 to obtain after cure a propellant which had a 71.7 powder to 28.3 solvent ratio and which had the following mechanical properties at a 0.74 in/in/min strain rate at 77° F: 450 psi modulus, 219 psi tensile strength and 62% elongation. A dumbbell did not break in 191 hours at 25° C when a 50 psi stress was applied (strain was 37%). One flammability cube burned in 28 days at 80° C.

EXAMPLE V

A casting powder and solvent which were identical in composition to those used in example IV were cured to obtain a cast propellant which had a 69.1 powder to 30.9 solvent ratio and which had the following mechanical properties at a 0.74 in/in/min strain rate at 77° F: 280 psi modulus, 172 psi tensile strength and 69% elongation. A dumbbell did not break in 434 hours at 25° C when a 50 psi stress was applied (strain was 47%).

EXAMPLE VI

A casting powder which was prepared using the techniques described in example I and which contained 12% of 12.6% N nitrocellulose, 4% of poly(ethyl acrylate-acrylic acid), 16% of 10 $\mu$ ammonium perchlorate, 33.3% of 25 $\mu$ HMX, 25% of Alcoa 123 aluminum, 1% 2-nitrodiphenylamine and 1.7% resorcinol was combined with a casting solvent containing 69.1% of nitroglycerin, 19.8% of bis(dinitropropyl) acetal, 8.9% of triacetin, 1% 2-nitrodiphenylamine and 1.2% of ERLA-0510 to obtain after cure a cast propellant which had a 72.4 powder to 27.6 solvent ratio, which had a modulus of 300 psi, tensile strength of 193 psi and elongation of 67% at a 0.74 in/in/min strain rate at 77° F and which did not break in 168 hours (strain was 55%) in a creep test when the initial stress was 50 psi.

EXAMPLE VII

A casting powder which was prepared using the techniques described in example I save that the powder size was 125 mil diameter and 125 mil average length and which contained 21% of 12.6% N nitrocellulose, 4% of poly(ethyl acrylate-acrylic acid), 49.5% of 10 $\mu$ ammonium perchlorate, 10% of aluminum foil (dimensions of 125 × 4.5 × 0.45 mil), 12.5% nitroglycerin, 1% of 2-nitrodiphenylamine and 2% resorcinol was combined with a casting solvent containing 75% of nitroglycerin, 22% of triacetin, 1% of 2-nitrodiphenylamine and 2% ERLA-0510 and cured for 11 days at 30° to 60° F and 7 days at 120° F to obtain a cast propellant which had a 68.1% powder to 31.9% solvent ratio. Dumbbells, which were postcured nine days at 120° F (total 16-day cure), gave a modulus of 290 psi, tensile strength of 110 psi and elongation of 48%. A dumbbell which was post-cured 16 days at 120° F (total 23-day cure), broke in 8 hours when an initial stress of 50 psi was applied (strain was >41%).

EXAMPLE VIII

A casting powder which was prepared using the techniques described in example I and which contained 8.7% of 12.6% N nitrocellulose, 2.9% of poly(ethyl acrylate-acrylic acid), 59.4% of 25 $\mu$ HMX, 22.2% of Alcoa 123 aluminum, 5.8% nitroglycerin and 1% of 2-nitrodiphenylamine was combined with a casting solvent containing 90% nitroglycerin, 8% triacetin, 1% of 2-nitrodiphenylamine and 1% of ERLA-0510 to obtain after cure a cast propellant which had a powder to solvent ratio of 71.3 to 28.7 and had a modulus of 175 psi, tensile strength of 118 psi and elongation of 107% (77 F and strain rate of 0.74 in/in/min.).

The compositions prepared in examples I – VIII are summarized in Table I. Control compositions (1-3) are the corresponding noncrosslinked nitrocellulose composite propellant and are identical in all respects save that no copolymer of ethyl acrylate and arcylic acid was present and no crosslinking agent was used.

Since the carboxyl-epoxide reaction is not affected by water, all propellants were void-free despite the fact that only conventional drying procedures were observed.

The foregoing compositions were then tested according to the following procedure:

TESTING PROCEDURE

Short type 2 (1.9 inch effective gage length, 3/8 inch width and 0.25 inch thick with 1/2 inch radius) JANAF dumbbells were used in uniaxial constant strain rate and creep tests. Dumbbells were prepared by sawing 1/4 inch slices of propellant using water as a coolant and by die cutting the slice so that the shape would be as described. Prior to testing, dumbbells were conditioned at a relative humidity of 50% or less. In the uniaxial strain tests, dumbbells were tested at a 0.74 in/in/min rate at the specified temperature on a Instron or a Baldwin testing machine and data were reduced from the resulting stress-strain curves. Elongation was measured at a point that was 5% below the maximum tensile strength and that was after the maximum tensile strength was attained. In creep tests, a 50 psi stress was applied to a dumbbell and the bench-marked dumbbell was periodically measured using a cathetometer until the dumbbell fractured or for at least 100 hours.

TABLE I

| EXAMPLE | PEA³(*) | Density (g/ml) Casting Powder | Density (g/ml) Cast Propellant | Composition of Composite Cast: NC(**) (%) | Stabilizers (%)*** Resorcinol | Stabilizers (%)*** NDPA | ERL-0510 (%) Total | ERL-0510 (%) Needed for PEA³ Reaction | ERL-0510 (%) Remainder for reaction with NC or res. | Ratio of NC To Epoxide Remainder |
|---|---|---|---|---|---|---|---|---|---|---|
| I | 1 | 1.827 | 1.774 | 19 | 1.19 | 1.00 | 0.31 | 0.04 | 0.27 | 49.2 |
| II | 3 | 1.885 | 1.783 | 17 | 1.22 | 1.28 | 0.37 | 0.11 | 0.26 | 46.9 |
| III | 2 | 1.847 | 1.778 | 18 | 1.21 | 1.00 | 0.34 | 0.07 | 0.27 | 47.4 |
| IV | 5 | 1.876 | 1.769 | 15 | 1.22 | 1.00 | 0.42 | 0.18 | 0.24 | 45.0 |
| V | 5 | 1.853 | 1.752 | 15 | 0.69 | 1.00 | 0.46 | 0.17 | 0.29 | 35.9 |
| VI | 4 | 1.901 | — | 12 | 1.23 | 1.00 | 0.33 | 0.14 | 0.19 | 45.7 |
| VII | 4 | 1.780 | — | 21 | 1.36 | 1.00 | 0.64 | 0.14 | 0.50 | 28.6 |
| VIII (Low Binder) | 2.9 | 1.919 | 1.797 | 8.7 | 0 | 1.00 | 0.28 | 0.10 | 0.18 | 30.9 |
| Control₁ | 0 | | | 20 | 0.7 | 1.0 | — | — | — | |
| Control₂ | 0 | — | — | 16 | 0.7 | 1.0 | — | — | — | |
| Control₃ | 0 | — | — | 24 | — | 1.00 | — | — | — | |

Percentage of
*Poly(acrylic acid-ethyl acrylate) in casting powder
**Nitrocellulose in casting powder
***2-Nitrodiphenylamine Table II summarizes the mechanical and creep properties of the cross-linked nitrocellulose propellants of this invention and compares the results with that obtained with the corresponding non-cross-linked propellants.

Table II

Mechanical and Creep Properties of Composite Propellants

| EX. | Cure Conditions, days/at ° F | CP Content (a) | Epoxide to NC Ratio (b) | Amount (%) of avail. NC found in gel network (c) | Mechanical Properties 120° F Mod psi | 120° F T.S. psi | 120° F El. (%) | 77° F Mod psi | 77° F T.S. PSI | 77° F El. (%) | −40° F Mod psi × 10² | −40° F T.S. psi | −40° F El. (%) | Creep Properties (d) Time (hr.) | Creep Properties (d) Strain |
|---|---|---|---|---|---|---|---|---|---|---|---|---|---|---|---|
| I | 3/70,14/120 | 69.9 | 0.111 | 10.4 | 370 | 125 | 49 | 590 | 240 | 60 | 450 | 2175 | 8 | >312 | 30 |
| II | 3/40,14/120 | 71.7 | 0.107 | 47.9 | — | — | — | 640 | 276 | 46 | 404 | 2360 | 8 | >191 | 34 |
| III | 3/70,14/120 | 71.4 | 0.106 | 12.8 | 360 | 120 | 42 | 660 | 250 | 52 | 415 | 2025 | 9 | >312 | 33 |
| IV | 3/40,7/120 | 71.7 | 0.114 | 48.2 | — | — | — | 445 | 255 | 65 | — | — | — | — | — |
| | 3/40,10/120 | | | | — | — | — | 450 | 255 | 64 | — | — | — | — | — |
| | 3/40,14/120 | | | | — | — | — | 450 | 219 | 62 | 300 | 2030 | 9 | >191 | 37 |
| V | 4/60,14/100 30/77 | 69.1 | 0.141 | 26.1 | 185 | 97 | 72 | 280 | 172 | 69 | 187 | 1400 | 17 | >434 | 47 |
| VI | 3/70,7/120 | 72.4 | 0.107 | 53.8 | — | — | — | 300 | 193 | 67 | — | — | — | >168 | 55 |
| | 3/70,16/120 | | | 54.5 | — | — | — | 350 | 201 | 64 | — | — | — | 109 | 50 |
| | 3/70,23/120 | | | — | 270 | 146 | 58 | 420 | 230 | 60 | — | — | — | 103 or 127 | 50 |
| VII | 11/50,7/120 | 68.1 | 0.216 | 25.5 | — | — | — | 220 | 101 | 58 | — | — | — | 0.05 | — |
| | 11/50,16/120 | | | 41.1 | — | — | — | 290 | 110 | 48 | — | — | — | >1.2, >1.75 | 37 |
| | 11/50,23/120 | | | 52.1 | 270 | 113 | 39 | 400 | 190 | 44 | — | — | — | 7.7 | 41 |
| VIII (Low Binder) | 3/40,14/120 | 71.3 | 0.143 | soft | — | — | — | 175 | 118 | 110 | 94 | 997 | 17 | — | — |
| Control₁ | 7/120 | 72 | — | — | 250 | 72 | 35 | 520 | 185 | 50 | 510 | 2300 | 7 | 2 | 25 |
| Control₂ | 7/120 | 73 | — | — | 270 | 64 | 32 | 530 | 190 | 40 | 398 | 1785 | 6 | — | — |
| Control₃ | 14/70,7/120 | 70.4 | — | — | 235 | 43 | 32 | 420 | 99 | 36 | 664 | 1640 | 3 | 0.1–0.9 | — |

(a) CP content shows weight percentage of casting powder in cast propellant.
(b) Based upon percentages of NC, PEA³ and epoxide in cast propellant and assumes the PEA³ is completely reacted and that remainder of epoxide can react with OH group of NC.
(c) Assumes that acetone insoluble material is composed of all aluminum, PEA³ and epoxide and that remainder is NC.
(d) Creep properties of specimens subjected to an initial stress of 50 PSI. The Time indicated is Time to fracture. The strain indicated is the maximum strain attained by the specimen prior to fracture.

Examples I through V describe data obtained from Control₁ type propellants in which from one to five parts of the 20 parts of nitrocellulose in the casting powder was replaced with PEA³ (poly(ethyl acrylate-acrylic acid)). Whereas Control₁ has a 2 hour creep life at an initial stress of 50 psi at 77° F, the corresponding cross-linked propellants have virtually an infinite creep life under the same conditions. The cross-linked propellant also had a higher tensile strength and % elongation at 120° F than did the non-cross-linked control.

Example VI describes data obtained from control₂ type propellant in which 4 parts of the 16 parts of nitrocellulose in the casting powder was replaced with PEA³. The control ruptured under a 50 psi load in 15 minutes at 77° F whereas the cross-linked propellant did not rupture in 168 hours. The cross-linked propellant had higher tensile strengths and elongations at 77° and 120° F than did the noncrosslinked propellant.

Example VII describes data obtained from control₃ type propellant in which 4 parts of the 21 parts nitrocellulose was replaced with PEA³. While the control broke under a 50 psi load in less than 1 hour, example VII broke in 8 hours.

It is apparent from this table that significant improvements in both resistance to creep and in mechanical properties, notable tensile strength and elongation at 120° F, are obtained by replacing a small portion of the nitrocellulose with a carboxy polymer such as poly (ethyl acrylate-acrylic acid) and cross-linking the two polymers with a curing agent such as an epoxide. The improvement is attributed to the fact that nitrocellulose is incorporated into the gel network. It has been shown that in the absence of the carboxy polymer, nitrocellulose reacts with the multifunctional epoxide but is not cross-linked.

As will be evident to those skilled in the art, various modifications can be made or followed, in the light of the foregoing disclosure and discussion without departing from the spirit or scope of the invention.

What is claimed as new and desired to be secured by Letters Patent of the United States is:

1. An energetic binder composition, particularly adaptable for use in a composite-modified double or single base propellant, which comprises the admixture of up to about 98.5% nitrocellulose with at least 1% of a carboxy polymer having a carboxyl equivalent of from about 0.03 to 0.06 equivalents/hundred grams, said admixture being cross-linked with a multifunctional curing agent in an amount sufficient to improve the mechanical properties of the binder relative to the corresponding non-cross-linked binder.

2. An energetic binder composition particularly adaptable for use in a composite-modified single or double base propellant, which comprises the admixture of up to about 98.5% nitrocellulose with at least 1% of an acrylic polymer having a carboxyl equivalent of from about 0.03 to 0.06 equivalents per hundred grams, said admixture being cross-linked with at least 0.5% of a multifunctional curing agent.

3. The energetic binder composition of claim 2 wherein the multifunctional curing agent is an epoxy resin selected from the group consisting of amino epoxy novalacs, condensation products of bisphenol A and epichlorohydrin, and cycloaliphatic epoxides.

4. The energetic binder composition of claim 3 wherein the multifunctional curing agent is N, N, O-tris epoxypropyl-p-aminophenol.

5. The energetic binder composition of claim 2 wherein the multifunctional curing agent is a multifunctional aziridinyl derivative.

6. The energetic binder composition of claim 5 wherein the curing agent is bis-(methyl-aziridinylethyl) sulfone.

7. The energetic binder composition of claim 2 wherein the acrylic polymer contains at least one monomer selected from the group consisting of the acid or lower alkyl ester of acrylic acid, methacrylic acid, sorbic acid, beta- acryloxpropionic acid, ethacrylic acid, 2-ethyl-3-propylacrylic acid, vinylacrylic acid, cinnamic acid, maleic acid and combinations thereof.

8. The energetic binder composition of claim 7 wherein the acrylic polymer is polyacrylic acid.

9. The energetic binder composition of claim 7 wherein the acrylic polymer is a copolymer of ethyl acrylate and acrylic acid.

10. The energetic binder composition of claim 7 wherein the acrylic polymer is a copolymer containing at least one non-acrylic monomer selected from the group consisting of methyl acrylate, methyl methacrylate, ethyl methacrylate, styrene, acrylonitrile, methacrylonitrile, vinylidene chloride, butadiene, isoprene, 2,3-dimethyl butadiene and chloroprene.

11. The energetic binder composition of claim 2 wherein minor amounts of nitrocellulose stabilizers selected from the groups of resorcinol and 2-nitrodiphenylamine are present in the mixture.

12. The energetic binder composition of claim 2 wherein the nitrocellulose is present in amounts of from about 10-98.5 wt. % and the acrylic polymer is present in amounts of from about 1-33 wt. %.

13. A composite propellant composition comprising;

a. a matrix of an energetic binder composition comprising the admixture of up to about 98.5% based on the weight of the binder of nitrocellulose with at least 1% based on the weight of the binder of an acrylic polymer having a carboxyl equivalent of from about 0.03 to 0.06 equivalents/hundred grams, said admixture being cross-linked with at least 0.5% of a multifunctional curing agent, and b. containing within said matrix up to 85%, based on the weight of the propellant composition of a particulate oxidizer.

14. A composite double base propellant composition comprising;

a. a matrix of an energetic binder composition comprising the admixture of up to about 98.5% based on the weight of the binder of nitrocellulose with at least 1% based on the weight of the binder of a copolymer of ethyl acrylate and acrylic acid, said admixture being cross-linked with at least 0.5% of an amino epoxy novalac curing agent, and b. containing within said matrix up to 65% of a particulate oxidizer.

15. The method of preparing composite double base propellant compositions comprising;

a. blending up to 98.5%, based on the weight of the binder, nitrocellulose with at least 1% based on the weight of the binder of a carboxy polymer having a carboxyl equivalent of from about 0.03 to 0.06 equivalents/hundred grams with a multifunctional curing agent in a suitable casting solvent.

b. admixing an oxidant in amounts of from 50%-85% based on the weight of the total composition, and c. curing the admixture for up to 14 days at 45°–60° C.

16. The method of claim 15 wherein the admixture is pretreated with solvent at 0°–30° C for 3 to 14 days prior to curing step (c) so as to swell and coalesce the casting powder.

* * * * *